US005617686A

United States Patent [19]

Gallagher, Jr.

[11] Patent Number: 5,617,686

[45] Date of Patent: Apr. 8, 1997

[54] INSULATING POLYMER WALL PANELS

[76] Inventor: Daniel P. Gallagher, Jr., 7662 Estate Cir., Niwot, Colo. 80503

[21] Appl. No.: 478,201

[22] Filed: Jun. 7, 1995

[51] Int. Cl.[6] ..... E04C 1/00

[52] U.S. Cl. ..... 52/309.12; 52/309.4; 52/285.1; 52/259; 52/586.1; 52/441; 52/437

[58] Field of Search ..... 52/309.1, 309.4, 52/309.12, 285, 586.1, 259, 437, 441

[56] References Cited

U.S. PATENT DOCUMENTS

| | | | |
|---|---|---|---|
| 1,884,319 | 10/1932 | Smith | 52/405.2 |
| 2,373,038 | 3/1945 | Westveer | 52/586.1 X |
| 3,410,044 | 11/1968 | Moog | 52/309.12 |
| 3,782,049 | 1/1974 | Sachs . | |
| 4,148,166 | 4/1979 | Toone | 52/309.12 |
| 4,443,988 | 4/1984 | Coutu, Sr. | 52/586.1 X |
| 4,485,604 | 12/1984 | Palamara et al. | 52/259 X |
| 4,532,745 | 8/1985 | Kinard . | |
| 4,641,468 | 2/1987 | Slater | 52/309.4 |
| 4,674,242 | 6/1987 | Oboler et al. | 52/441 X |
| 4,823,534 | 4/1989 | Hebinck . | |
| 4,860,515 | 8/1989 | Browning, Jr. . | |
| 4,944,127 | 7/1990 | Clear . | |
| 5,079,885 | 1/1992 | Dettbarn . | |
| 5,123,222 | 6/1992 | Guarrielo et al. | 52/309.12 |
| 5,172,532 | 12/1992 | Gibbar, Jr. . | |
| 5,216,854 | 6/1993 | Emmert . | |
| 5,279,088 | 1/1994 | Heydon . | |
| 5,377,470 | 1/1995 | Hebinck . | |

FOREIGN PATENT DOCUMENTS

| | | | |
|---|---|---|---|
| 2438890 | 3/1975 | Germany | 52/309.12 |
| 2914920 | 10/1979 | Germany | 52/259 |
| 2854476 | 7/1980 | Germany | 52/309.4 |
| 453906 | 9/1936 | United Kingdom | 52/259 |
| 562028 | 6/1944 | United Kingdom | 52/586.2 |
| 2057529 | 4/1981 | United Kingdom | 52/586.1 |

OTHER PUBLICATIONS

Product information, *Amhome Building System* (3 pages).
Product information (1994), *Ener•G Corp.* (4 pages).
Product information, *Rastra of the Americas L.L.C.* (4 pages).
Product information (1994), *Echo Homes, Ltd.* (5 pages).
Product information (1994), *ThermoFormed*™ (4 pages).
Product information, *Techbuilt Systems Inc.* (8 pages).
Product information, *CoreForm*™ *Building System* (14 pages).

*Primary Examiner*—Carl D. Friedman
*Assistant Examiner*—Aimee E. McTigue
*Attorney, Agent, or Firm*—Greenlee, Winner and Sullivan, P.C.

[57] ABSTRACT

A insulating foamed polymer wall panel comprising a sheet of foamed polymer having sizable dimensions to form a substantial part of a wall when assembled. Adjacent wall panels are coupled using splines which, together with the side edges of the panels, form the sidewalls of a cement channel between the panels. The panel has connecting slots for receiving the splines and a plurality of edges, each top and side edge having a longitudinally extending groove to accommodate the fill of cement therein. The grooves provide tongue-and-groove connections between the cement post and adjacent wall panels once the cement has set, thus locking the latter into place.

20 Claims, 7 Drawing Sheets

INSULATING POLYMER WALL PANELS

FIELD OF THE INVENTION

This invention relates generally to prefabricated wall panels and wall panel assemblies. More particularly, this invention relates to insulating foamed polymer wall panels which are uniquely assembled using splines and cement.

BACKGROUND OF THE INVENTION

A variety of prefabricated polymer building components have been designed for improving the insulation R-factor of exterior walls. Most such building components comprise foamed or plastic materials and involve either foam-core panels or building blocks. Prefabricated foam-core panels typically comprise a solid foam core sandwiched between two layers of rigid materials, including oriented strand board, waferboard, plywood and thin sheet metal. Foamed plastic building blocks typically have hollow passages which form a series of interlocking vertical and horizontal passages in the assembly. The passages may be filled with concrete during assembly. After the concrete solidifies, the foamed blocks may be left in place as insulation.

Various foamed plastic building blocks have been designed for specific applications and to obviate particular problems. U.S. Pat. No. 3,782,049 (Sachs) and U.S. Pat. No. 4,532,745 (Kinard) disclose wall forming blocks made of foamed plastic material, and having vertical openings and upwardly opening channels extending along their upper edges. The blocks are stacked in courses to form a wall, and a concrete slurry is poured or pumped into the openings and channels to form a concrete grid within the wall. Both blocks include attachment means for anchoring cladding materials, but require significant quantities of concrete to assemble. U.S. Pat. No. 4,860,515 (Browning, Jr.) also discloses a self-supporting, self-insulating form for use in construction with concrete. Although this design also provides an improved means for attaching materials to the polymer block, it requires a significant amount of concrete and a number of components, including internal folding metal plates and pivotable wing structures. U.S. Pat. No. 4,823,534 (Hebinck) discloses a method for forming building walls using polystyrene blocks, wherein the blocks comprise vertical voids and horizontal depressions. The voids and depression are filled with concrete to form concrete posts and beams. This design purportedly provides a wall with improved R value but, like the above-described blocks, requires a significant amount of concrete and numerous components, including horizontal and vertical reinforcing rods which must be hooked and intertwined during assembly.

A wide variety of foam wall panels are also available for use with conventional wood frames and concrete. U.S. Pat. No. 4,944,127 (Clear) discloses a composite panel for use with wood frame construction having increased resistance to delamination. The panel comprises a foam layer with inclined grooves and an overlaying concrete layer with integral projections extending into the grooves. U.S. Pat. No. 5,079,885 (Dettbarn), U.S. Pat. No. 5,279,088 (Heydon) and U.S. Pat. No. 5,377,470 (Hebinck) each disclose wall panels or wall panel assemblies comprising wooden posts and rigid foam plastic panels extending between adjacent posts. U.S. Pat. No. 5,216,854 (Emmert) discloses a building system which utilizes laminated panels for the walls and for a self supporting cathedral-type roof. U.S. Pat. No. 5,172,532 (Gibbar, Jr.) discloses a reinforced polymer wall panel having a sculptured grooved surface, preferably including reinforcement rods, and a concrete overlay. The grooves may be shaped as an I-beam for enhanced reinforcement and to strengthen the panels.

Despite the number and variety of products and techniques known for building energy-efficient walls using foam blocks or panels, the use of these materials and techniques has resulted in only moderate success. All known building structures of this type have certain inherent limitations and disadvantages. While certain prior foam products permit the construction of well insulated walls, all require either a large number of components, a wood frame or substantial quantities of cement. Such structures are therefore difficult or expensive to manufacture and/or assemble.

The present invention specifically addresses these and other deficiencies in the prior art and provides an insulated polymer wall panel structure that is economical, simple to manufacture and assemble, termite resistant, employs a minimal number of components, and requires a minimal amount of concrete.

SUMMARY OF THE INVENTION

The present invention comprehends an improved insulating foamed polymer wall panel which, while being simple and economical in design, avoids the above-described problems associated with prior art devices.

More specifically, the present invention provides improved insulating foamed polymer wall panels which are uniquely assembled using splines and cement. This novel design reduces the installation time typically associated with the construction of insulated wall structures by providing a simple and readily assembled wall panel assembly. The present design also reduces the number of components and the quantity of cement required to assemble prior wall structures of this type.

The panel of the present invention is a monolithic structure constructed of foamed polymer, and more specifically polymers such as polystyrene, foamed polyurethane, and the like. The panel comprises a sheet of foamed polymer having sizable dimensions to form a substantial part of a wall when assembled. The panels of the invention range in size from about sixteen inches to about seven feet in width and about six feet to about twenty-four feet in height, preferably at least about four feet by six feet in width and height dimensions, respectively, and most preferably at least about five feet by about seven feet. As will be appreciated by those skilled in the art, although the width of the standard panel is preferably about four feet to five feet, modifications will be required to accommodate corners, doorways, windows, and the like. Similarly, although the height of the panel is preferably about seven feet for conventional residential housing, the height will vary considerably for custom housing and industrial applications.

The panel of the present invention has inner and outer surfaces and a plurality of edges, each top and side edge having a longitudinally extending groove to accommodate the fill of cement therein. The panel also has a longitudinally extending connecting slot formed on the inner surface of each top and side edge for receiving a portion of a first spline therein. During assembly, adjacent panels are joined by means of an adhesive, or other fastening means, applied to the first spline and/or to the connecting slots of the adjacent wall panels. The first spline is inserted into and secured to the connecting slots on the inner surface, and a second spline is secured at a corresponding location on the outer surface, also by means of an adhesive. The splines, together with the side edges of the panels, serve as the sidewalls of a channel between adjacent wall panels for receiving cement therein. The channel is filled with a cement such as concrete, which functions as a vertical structural post after it has solidified. The longitudinally extending grooves on the side edges of each panel also fill with cement, thereby forming tongue-and-groove connections between each vertical post and adjoining wall panels, which lock the latter into place once the cement has set. The tongue-and-groove connections further reinforce the wall panel assembly. The wall panel assemblies of the present invention have great rigidity because of the concrete posts and tongue-and-groove interconnections, and are well insulated because of the high R value of the foamed polymer insulating material.

After the wall panel assembly has been installed, interior and exterior finishing surfaces may be applied using standard construction techniques. Gypsum board is generally attached to the interior of the wall panel assembly; however, any appropriate finish may be applied. An appropriate exterior finishing surface such as stucco, Exterior Insulation and Finish Systems (EIFS), brick or siding is generally attached to the outer surface of the wall panel assembly. In a preferred embodiment, an EIFS is applied to the wall panels during the manufacturing process, before transport to the construction site.

The exact nature of this invention as well as other features and advantages thereof will be readily apparent from consideration of the specification, including the drawings. Those of skill in the art will appreciate that the invention described herein is susceptible to many modifications and variations without departing from its scope as defined by the appended claims.

BRIEF DESCRIPTION OF THE DRAWINGS

The accompanying drawings illustrate preferred embodiments of the invention, wherein.

DESCRIPTION OF THE PREFERRED EMBODIMENTS

Figure 1:
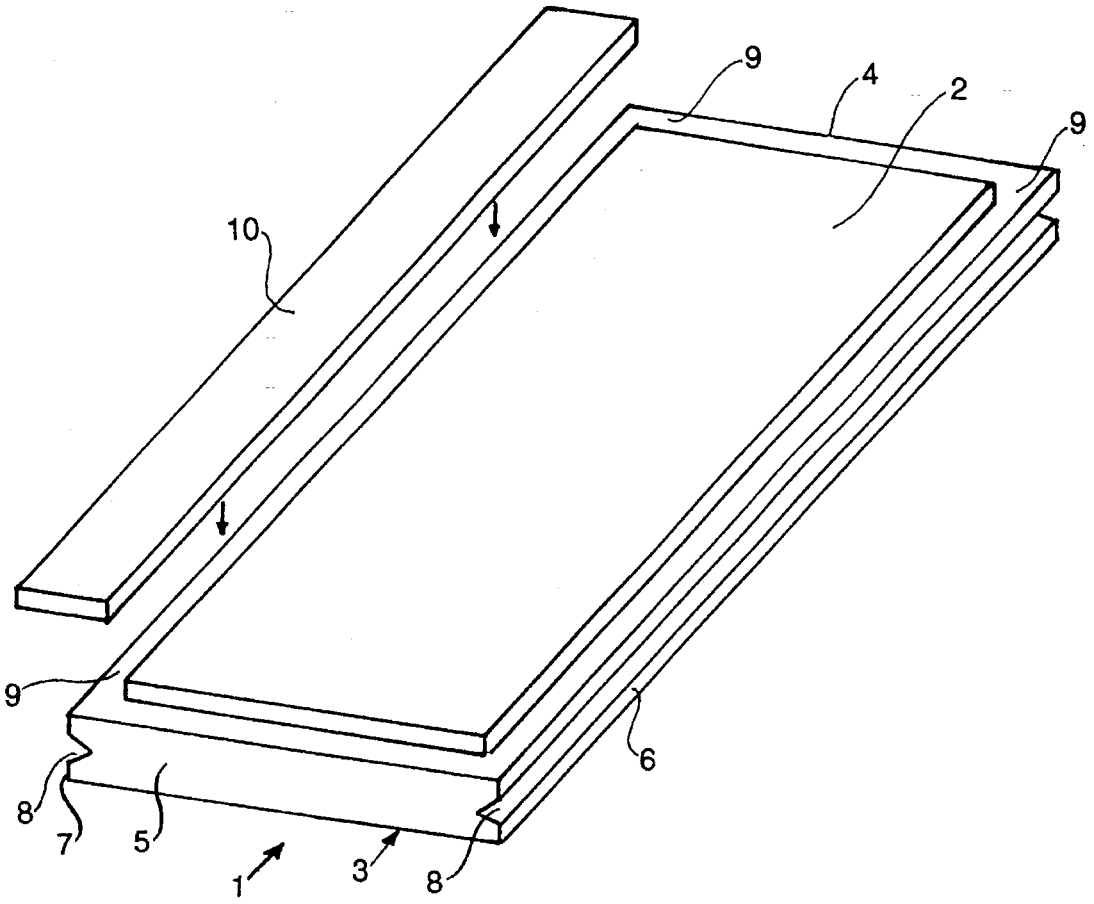
FIG. 1 is a perspective view of the insulating polymer wall panel in an embodiment of the present invention.

Referring now to the drawings, like numbers indicate like features and the same number appearing in more than one figure refers to the same element.

FIG. 1 illustrates an insulating polymer wall panel comprising a sheet of foamed polymer I which may comprise a slab of polystyrene or other polymeric material. The sheet of foamed polymer 1 has sizable dimensions to form a substantial part of a wall when assembled, generally between about sixteen inches and seven feet in width, between about six feet and twenty-four feet in length, and between about four inches and twelve inches in thickness; preferably at least approximately four feet in width, six feet in length, and seven inches in thickness; and more preferably at least about five feet in width, seven feet in length, and seven inches in thickness. In the presently preferred embodiment, the sheet of foamed polymer 1 is about five feet four inches in width, about seven feet in length and about seven inches in thickness. The sheet of foamed polymer 1 has an inner surface 2 and an outer surface 3 and a plurality of edges, including a top edge 4, a bottom edge 5, a first side edge 6 and a second side edge 7. Each of said top edge 4 and side edges 6 and 7 has a longitudinally extending groove 8 formed therein. During assembly, the longitudinally extending groove 8 fills with cement to provide a tongue-and-groove connection between the sheet of foamed polymer 1 and the vertical post and horizontal beam (not shown), thereby reinforcing the wall panel assembly. The longitudinally extending groove 8 may be formed in the sheet of foamed polymer 1 during the molding process or may be cut into the formed sheet of foamed polymer 1 by techniques known in the art, for example using a hot wire cutter. Also as shown in FIG. 1, the sheet of foamed polymer 1 further comprises a longitudinally extending connecting slot 9 on each of top edge 4 and side edges 6 and 7. Connecting slot 9 is formed on the inner surface 2 of the side edge 7 of the sheet of foamed polymer 1 to accommodate a portion of a first spline 10 therein. A connecting slot 9 is also formed on the inner surface 2 of the top edge 4 to accommodate a portion of an inner spline 20 (seen in FIG. 2) during the construction of a horizontal beam, as described below. Like groove 8, connecting slot 9 may be formed in the sheet of foamed polymer 1 during the molding process or may be cut into the formed sheet of foamed polymer 1 using known techniques.

Figure 2:
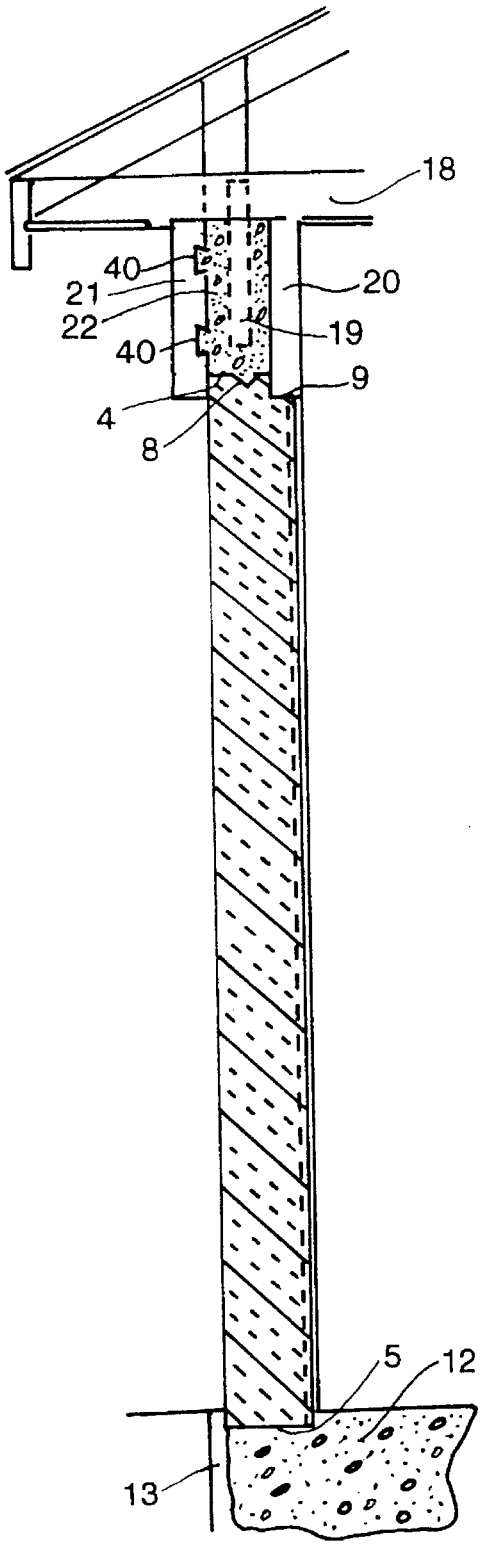
FIG. 2 is a vertical sectional view through a wall panel assembly in an embodiment of the present invention.

Wall structures are formed by coupling adjacent sheets of foamed polymer 1 using splines and cement, as shown in FIGS. 2 through 7. A site is first prepared by standard construction practices and a foundation constructed to support flooring and the wall panel assembly. The flooring typically comprises a concrete slab 12 supported by concrete footers (not shown). Referring to FIG. 2, concrete slab 12 is poured with reinforcing rods (not shown) placed at predetermined locations around the perimeter. Concrete slab 12 can be poured using a variety of commercially available materials and well known techniques, preferably including at least one support form 13 as illustrated herein. In a preferred embodiment, support form 13 is formed of an insulating material, such as expanded polystyrene. After initial hardening of the poured concrete commences, bottom edge 5 of the sheets of foamed polymer 1 are implanted into the slab 12 between each adjacent reinforcing rod (not shown), preferably abutting a support form 13. If desired, bottom edge 5 may be caulked with an appropriate sealant to strengthen the panel assembly and to provide a moisture barrier to prevent the ingress of moisture into the building.

Figure 3:
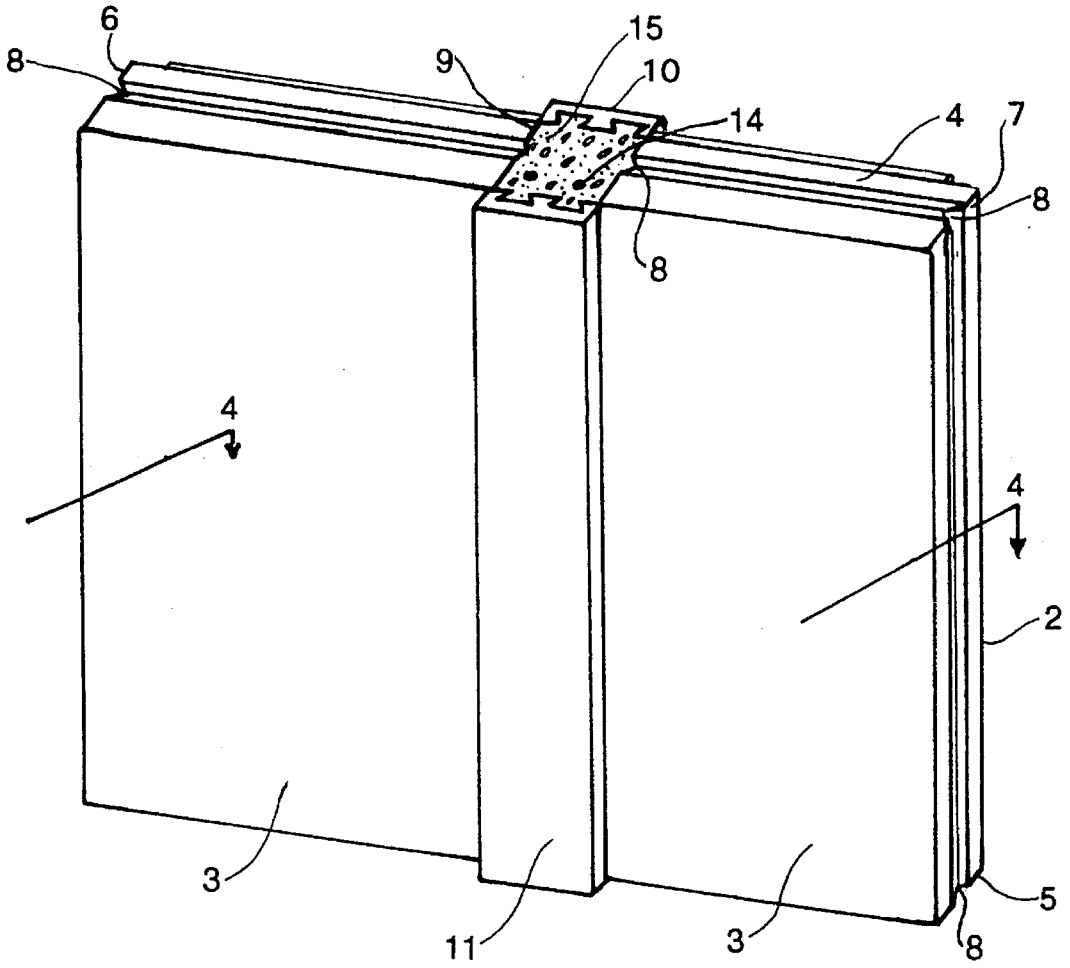
FIG. 3 is a partial perspective view of the wall panel assembly in an embodiment of the present invention.
Figure 4:
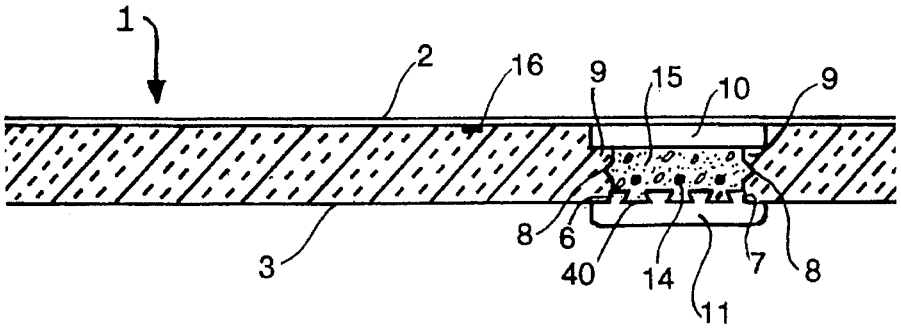
FIG. 4 is a horizontal sectional view taken along line 4—4 of FIG. 3.

Adjacent sheets of foamed polymer 1 are initially connected by means of an adhesive, or other fastening means, applied to the first spline 10 and/or to the connecting slots 9 on each of the opposing side edges 6 and 7 of adjacent panels. As shown in FIGS. 3 and 4, a first spline 10 is inserted into and adhesively secured to the connecting slots 9 on inner surfaces 2 of adjacent panels. A second spline 11 is then secured at a corresponding location on the outer surfaces 3 of adjacent panels, generally parallel to first spline 10, also by means of an adhesive. Splines 10 and 11, together with the side edges 6 and 7, serve as the sidewalls of a channel 15 between adjacent panels for receiving cement therein. After the wall panel is assembled, channel 15 is filled with a cement such as concrete, which functions as a vertical structural post after it has solidified. A reinforcing rod 14 may be embedded in the cement and extend vertically within channel 15.

An important feature of this invention is the formation of a good mechanical bond between the sheets of foamed polymer 1 and the vertical structural posts formed within channel 15. As channel 15 fills with cement, longitudinally extending groove 8 on side edges 6 and 7 also fills with cement, thereby forming a tongue-and-groove connection between the vertical structural post and each adjoining wall panel. The tongue-and-groove connections function as mechanical grips to lock the panels in place, thus reinforcing the wall panel assembly. The wall panel assembly of the present invention has great rigidity because of the concrete posts and tongue-and-groove connections.

In a preferred embodiment, shown in FIG. 4, at least one furring strip 16 is inserted within or secured to the inner surface 2 of the sheet of foamed polymer 1. Furring strip 16 may be formed of any conventional furring strip material, preferably oriented strand board. Preferably, at least three well-spaced strips are provided for each sheet of foamed polymer 1, with the strips all being parallel and running vertically from top edge 4 to bottom edge 5. For various specific purposes, furring strips 16 may be otherwise arranged upon the sheets and may be formed of different materials. Furring strips 16 may be inserted within the sheet of foamed polymer 1 prior to the panel's erection, and preferably prior to transport to the construction site. A slot for furring strip 16 may be formed in the sheet of foamed polymer 1 during the molding process or may be cut into the formed sheet of foamed polymer 1 by splicing techniques known in the art. Alternatively, furring strip 16 may be secured to the inner surface 2 by any suitable attachment means.

As previously mentioned and as shown in FIG. 2, top edge 4 has a longitudinally extending groove 8 formed therein. In a preferred embodiment, sheet of foamed polymer 1 further comprises a longitudinally extending connecting slot 9 formed on the top edge 4 and the inner surface 2 for receiving a portion of a first spline therein. After the wall panel assembly has been erected, the panel assembly is joined to a rafter or truss element 18 by means of a connector plate 19, such as a "Hurricane" clip or a Simpson™ embedded tie. As shown in FIG. 2, an inner spline 20 is inserted into and adhesively secured to the connecting slot 9 on top edge 4, and an outer spline 21 is secured at a corresponding location on the outer surface, also by means of an adhesive. The splines, together with top edge 4, serve as the sidewalls of a channel 22 along the top edge 4 of the wall panel assembly. The channel 22 is filled with a cement such as concrete, which functions as a horizontal structural beam after it has solidified. Before initial hardening of the concrete commences, connector plate 19 is substantially submerged therein. Connector plate 19 is securely attached to truss element 18 by conventional fastening means, such as tech nails or screws. The horizontal grooves 8 on the top edges of each panel fill with cement, thereby forming tongue-and-groove connections between the horizontal beam and top edge 4 of the wall panels. The tongue-and-groove connection serve to further reinforce the wall panel assembly.

Figure 6:
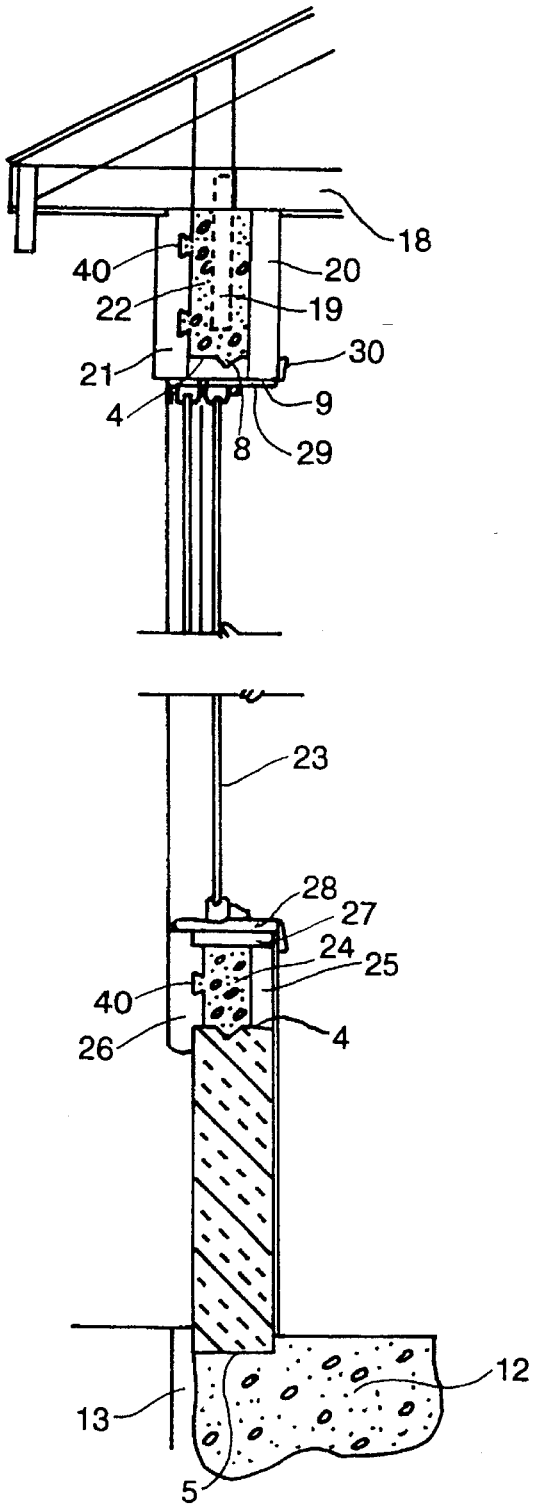
FIG. 6 is a vertical sectional view through a wall panel assembly with a window installed therein.
Figure 7:
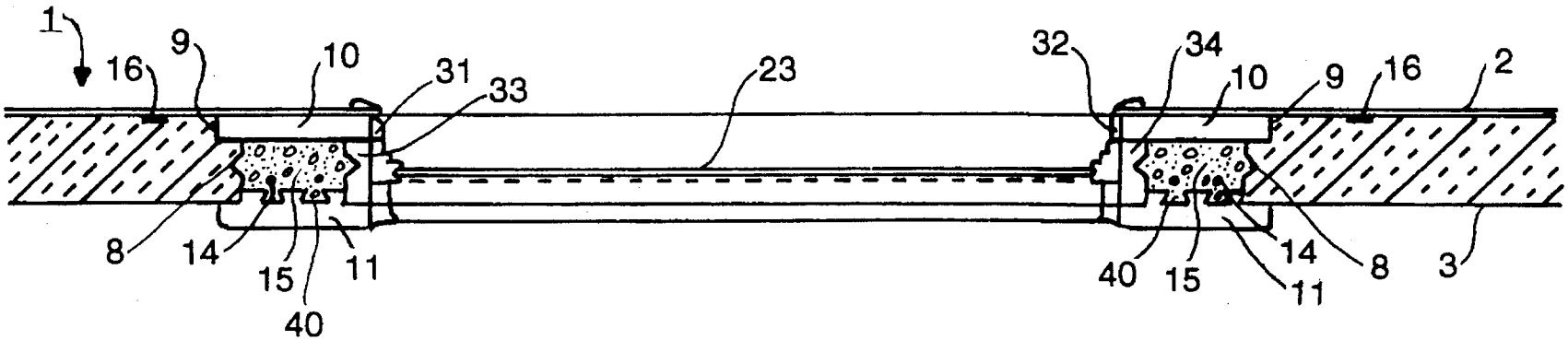
FIG. 7 is a horizontal sectional view through a wall panel assembly with a window installed therein.

When a window installation is desired or required, wall panels are formed to integrate with the window structures, as exemplified in FIGS. 6 and 7. Windows may be formed of any suitable framing material, including wood, vinyl or metal. As will be understood by those skilled in the art, the width or height of the panels must be altered to accommodate the window 23. Panel dimensions may be modified at the construction site as necessary by cutting the panels with standard construction tools to remove a portion thereof. Preferably, panels are fabricated having predetermined dimensions to accommodate the desired window structures. As shown in FIG. 6, channel 24 is formed below the window 23 using inner spline 25 and outer spline 26, as previously described for channel 22. The splines, together with top edge 4 of the supporting wall panel, serve as the sidewalls of channel 24. Channel 24 is filled with cement and covered with a lower panel member 27. After the cement in channel 24 has solidified, it functions as a horizontal structural beam to support the window 23. In a preferred embodiment, window 23 is attached to a base plate 28 by means of an adhesive, which in turn is adhesively attached to lower panel member 27. Once window 23 is installed, horizontal top plate 29 is adhesively attached to an upper panel member 30, and splines 20 and 21 are adhesively secured thereto. The horizontal structural beam is formed by pouring cement into channel 22, as previously discussed. As shown in FIG. 7, window 23 is coupled to adjacent wall panels using splines and cement as previously described for coupling adjacent panels, except that side plates 31 and 32 are adhesively secured to side panel members 33 and 34, respectively. Panel members 27 and 30 may be formed of any suitable construction material, preferably a foamed polymer material such as expanded polystyrene due its superior insulating properties. Horizontal base plate 28 and top plate 29 may be formed of any suitable material including, without limitation, wood, gypsum board, metal or marble.

Figure 8:
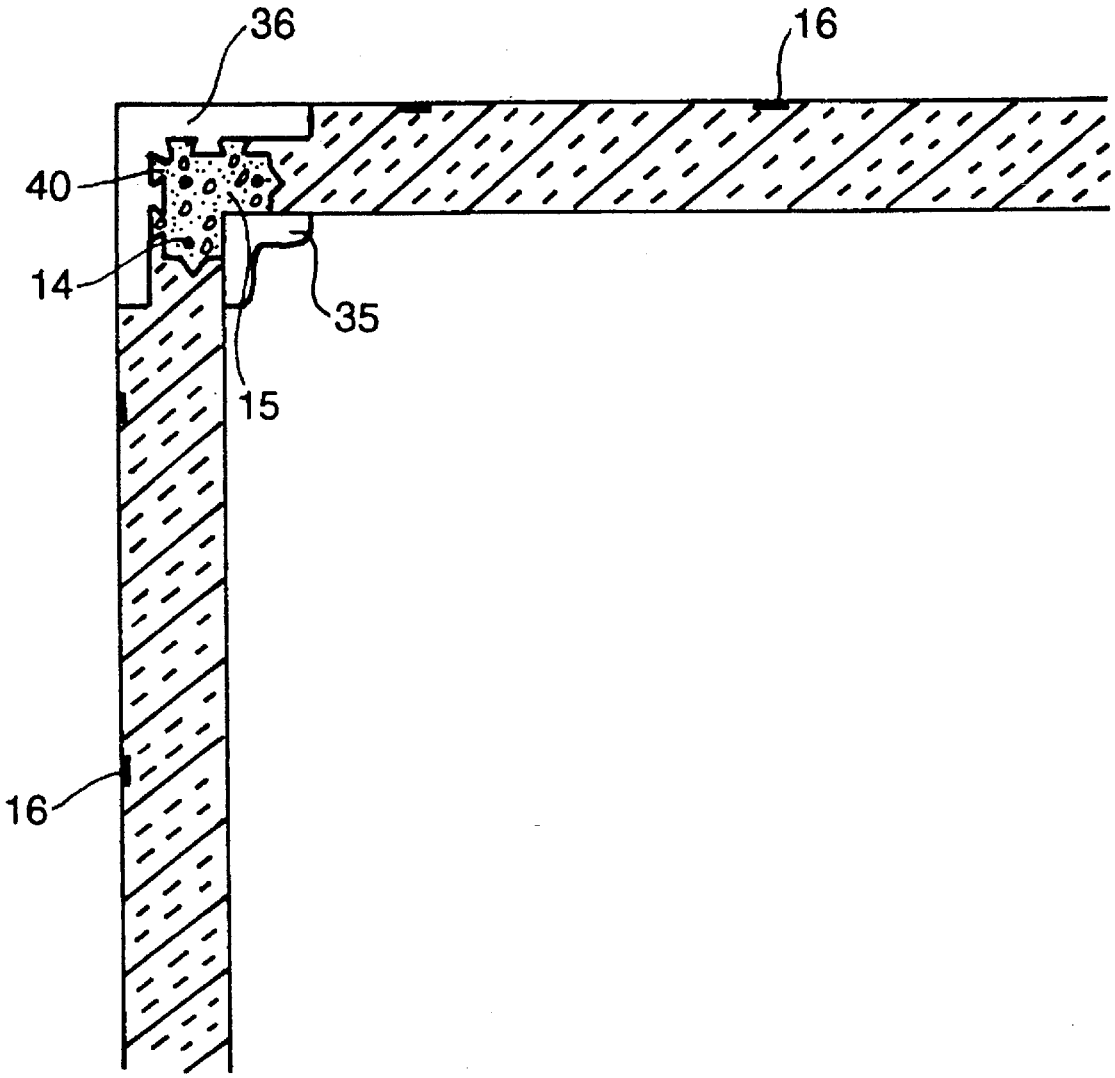
FIG. 8 is a horizontal sectional view similar to FIGS. 4 and 5, showing an example of right-angle wall construction in accordance with the present invention.

FIG. 8 illustrates an example of right-angle wall construction using the wall panels of the present invention. As shown therein, corners are formed using standard wall panels and angular splines 35 and 36. Although the present application exemplifies right-angle corner construction, those of skill in the art will appreciate that corners having an acute or obtuse angle can be constructed simply by varying the angles of splines 35 and 36.

After the wall panel assembly has been erected, an interior finishing surface of a selected cladding material may be installed using standard construction techniques, a wide variety of cladding materials being known in the art. The cladding material is preferably attached to furring strip 16 using standard attachments means such as nails or screws. Alternatively, or in addition, the cladding material may be directly secured to the inner surface 2 by means of an adhesive, or other fastening means. In a preferred embodiment, the interior cladding material is gypsum board.

Various cladding materials may also be applied to the outer surface 3 of the wall panel assembly. Suitable exterior cladding materials include, without limitation, stucco, Exterior Insulation and Finish Systems (EIFS), brick and siding. The exterior cladding material may be attached to outer surface 3 through a variety of known techniques, for example using furring strips 16 as previously described. Alternatively, or in addition, the cladding material may be directly secured to the outer surface 3 by means of an adhesive, or other fastening means. In a preferred embodiment (not shown), an EIFS is applied to the exterior surface 3 of the wall panel during the manufacturing process, prior to transport to the construction site. As used herein and consistent with common usage, EIFS refers to a variety of non-load bearing exterior wall cladding systems which are similar in certain respects to traditional portland cement plaster (stucco), but comprise a combination of synthetic and natural materials. EIFS claddings are well known in the art and described, for example, in M. F. Williams and B. L. Williams (1994) "Exterior Insulation and Finish Systems, Current Practices and Future Considerations," Am. Society for Testing Materials (Philadelphia, Pa.), incorporated by reference in its entirety herein.

Figure 5:
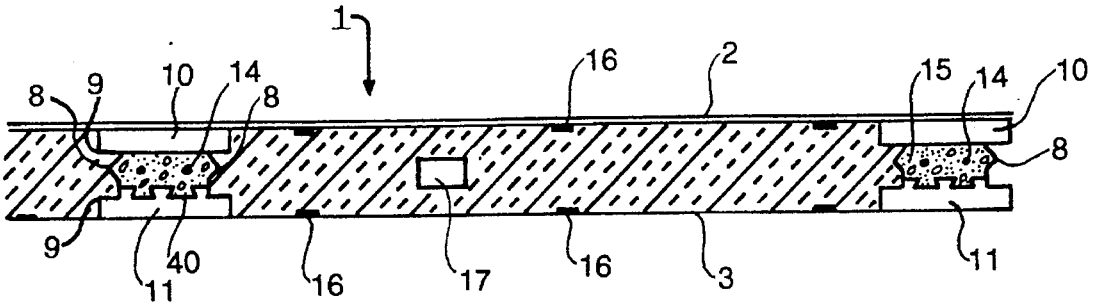
FIG. 5 is a horizontal sectional view taken along a line analogous to line 4—4 of FIG. 3, in an alternate embodiment of the present invention.

In an alternate preferred embodiment shown in FIG. 5, the sheet of foamed polymer 1 also has a longitudinally extending connecting slot 9 formed on the outer surface 3 of side edges 6 and 7 for receiving a portion of a second spline 11 therein. Second spline 11 is secured to connecting slot 9 on the outer surface by means of an adhesive or other fastening means. In the wall panel assembly of this embodiment, both first spline 10 and second spline 11 are inserted into recessed connecting slots, thereby providing smooth surfaces for the attachment of interior and exterior cladding materials, respectively. In this alternate preferred embodiment, the exterior cladding material is preferably attached to furring strips 16 and/or directly to the outer surface 3 after completion of the wall panel assembly.

Vertical columns 17 may be cut into the sheet of foamed polymer 1 to receive electrical wires, as shown in FIG. 5. Optionally or in addition, recesses or openings (not shown) may be cut into the inner and/or outer surfaces of foamed polymer 1 to receive various wall attachments, such as electrical outlet boxes, cabinets, cupboards and the like.

The insulating polymer wall panels of the present invention may be formed of any suitable insulating material, a wide variety of which are known and commercially available. In the presently preferred embodiment of the invention, the wall panel is formed of a foamed polymer material including, without limitation, styrene polymer foams, styrene acrylonitrile copolymer foams, styrene-methylmethacrylate copolymer foams, polyvinylchloride foams, polyurethane foams, polyethylene foams and phenolic foams. Preferably, the foamed polymer material is expanded polystyrene.

Splines 10, 11, 20, 21, 25, 26, 35 and 36 may be formed of any suitable construction material such as a wood, metal, plastic or foam. In the presently preferred embodiment of the invention, the splines are formed of a foamed polymer material such as expanded polystyrene because of its superior insulating properties. Preferably, one or both of splines 10 and 11 (or splines 20/21, 25/26, or 35/36) have one or more longitudinally extending recessed grooves 40 on their inner surfaces which, like the longitudinally extending grooves 8, function as a mechanical grip to further reinforce the wall panel assembly. Each spline has a length dimension equivalent to its corresponding connecting slot 9. Width and thickness may vary depending upon the particular application, although the spline must have an adequate width so that the channel, when filled with cured cement, provides a sufficiently sturdy post or beam. Preferably, the splines are at least about eight inches wide and about one inch thick, more preferably at least about one foot wide and about two inches thick. Thus, in the wall panel assembly exemplified herein, splines 20 and 21, together with the exemplified wall panel, form a wall structure of at least eight feet in height.

The cement may be any suitable material known in the art, preferably 3,000 PSI concrete.

Upon completion, the wall becomes a load bearing wall capable of supporting substantial loads, at the same time also giving the appearance and structure of a conventional wall. The wall panel assemblies of the present invention have great rigidity because of the concrete posts and tongue-and-groove interconnections, and are well insulated because of the high R value of the foamed polymer insulating material.

Various modifications and variations to the presently illustrated and discussed embodiments may be practiced by those of ordinary skill in the art without departing from the spirit and scope of the present invention. For example, the size and precise shape of insulating wall panels, and the various elements and features thereof, need not be limited to the specific details of the presently preferred exemplary embodiments, which are set forth as examples only and not intended as limiting to the present invention.

It is therefore to be understood that within the scope of the appended claims, the invention may be practiced in ways other than as specifically described herein.

I claim:

1. A wall panel assembly comprising:

a wall panel sheet having an inner surface and an outer surface and a top and side edges;

a longitudinally extending groove formed in at least one of said edges;

a first spline secured to said inner surface at said edge having said groove and a second spline secured to said outer surface at said edge having said groove, whereby said splines and said edge having said groove define walls of a channel; cement filled into said channel and said groove to form a structural post or beam.

2. The panel assembly of claim 1 having a connecting slot formed into the inner surface of said sheet to accommodate one of said splines.

3. The panel assembly of claim 1 having a connecting slot formed into the outer surface of said sheet to accommodate one of said splines.

4. The panel assembly of claim 1 having connecting slots formed into the inner and outer surfaces of said sheets to accommodate said splines.

5. The panel assembly of claim 1 wherein said side edge has a longitudinal groove therein and said cement fills into a channel having a wall defined by said side edge having said groove and forms a vertical structural post.

6. The panel assembly of claim 1 wherein said top edge has a longitudinal groove therein and said cement fills into a channel having a wall defined by said top edge having said groove and forms a horizontal structural beam.

7. The panel assembly of claim 1 wherein said wall panel sheet is a foamed polymer sheet.

8. The panel assembly of claim 7 wherein said foamed polymer sheet is comprised of a foam material selected from the group consisting of styrene polymer foams, styrene acrylonitrile copolymer foams, styrene-methylmethacrylate copolymer foams, polyvinylchloride foams, polyurethane foams, polyethylene foams and phenolic foams.

9. The panel assembly of claim 8 wherein said polymer foam is expanded polystyrene.

10. The panel assembly of claim 1 comprising a plurality of said wall panel sheets wherein said cement fills into communicating channels having walls defined by said top and side edges and into grooves in said top and side edges of said sheet to form a horizontal beam and vertical structural post.

11. The panel assembly of claim 1 further comprising at least one furring strip attached to the inner or outer surface of said wall panel sheet.

12. The panel assembly of claim 1 further comprising an interior finishing surface of selected cladding material.

13. The panel assembly of claim 1 further comprising an exterior finishing surface of selected cladding material.

14. The panel assembly of claim 1 further comprising a second channel encased within said sheet, whereby wiring may be inserted in said wall panel.

15. The panel assembly of claim 1 wherein said first and second splines comprise a foamed polymer material.

16. The panel assembly of claim 1 wherein said cement is 3,000 PSI concrete.

17. The panel assembly of claim 1 comprising a reinforcing rod extending within said channel and embedded in the cement occupying said channel.

18. The panel assembly of claim 1 wherein said groove extends the entire length of said edge.

19. The panel assembly of claim 1 wherein said splines comprise longitudinal grooves.

20. An insulating wall panel assembly comprising:

a plurality of foamed polymer wall panel sheets having inner and outer surfaces and top and side edges, wherein the side edges of at least two of said sheets are placed spaced apart and parallel to each other;

longitudinally extending grooves formed in said top and side edges;

inner splines having longitudinal grooves secured to said inner surfaces of said sheets at said side edges and outer splines having longitudinal grooves secured to said outer surfaces of said sheets at said side edges, whereby said splines having said grooves and said side edges having said grooves define walls of a side channel;

a first reinforcing rod placed within said side channel;

cement filled into said side channel and said grooves to form a structural vertical post;

inner and outer splines having longitudinal grooves secured to the inner and outer surfaces of said sheets at said top edges having said grooves, whereby said splines having said grooves and said top edges having said grooves define walls of a top channel;

a second reinforcing rod placed within said top channel; cement filled into said top channel and said grooves to form a structural horizontal beam, wherein said vertical post and horizontal beam are integrally connected.

* * * * *